United States Patent [19]

Noda et al.

[11] Patent Number: 5,000,027

[45] Date of Patent: Mar. 19, 1991

[54] FINGER TILTING APPARATUS FOR TRANSFER FEEDER

[75] Inventors: Shigekazu Noda, Kanazawa; Nobuyuki Kaji, Komatsu, both of Japan

[73] Assignee: Kabushiki Kaisha Komatsu Seisakusho, Japan

[21] Appl. No.: 415,322

[22] PCT Filed: Jan. 18, 1989

[86] PCT No.: PCT/JP89/00037

§ 371 Date: Sep. 14, 1989

§ 102(e) Date: Sep. 14, 1989

[87] PCT Pub. No.: WO89/06574

PCT Pub. Date: Jul. 27, 1989

[30] Foreign Application Priority Data

| | | | |
|---|---|---|---|
| Jan. 19, 1988 | [JP] | Japan | 63-7569 |
| Jun. 30, 1988 | [JP] | Japan | 63-85761[U] |
| Jun. 30, 1988 | [JP] | Japan | 63-85762[U] |

[51] Int. Cl.[5] ..... B21J 13/08

[52] U.S. Cl. ..... 72/405; 198/621; 198/375

[58] Field of Search ..... 72/405, 421; 198/375, 198/376, 621, 774; 414/750

[56] References Cited

U.S. PATENT DOCUMENTS

| | | | |
|---|---|---|---|
| 2,259,728 | 10/1941 | Bridges | 198/375 |
| 2,934,194 | 4/1960 | Adams | 198/621 |
| 4,680,954 | 7/1987 | Mueller | 198/621 |

FOREIGN PATENT DOCUMENTS

| | | | |
|---|---|---|---|
| 2455931 | 1/1981 | France | 72/405 |
| 10754 | 4/1985 | Japan . | |
| 101636 | 6/1987 | Japan . | |
| 142431 | 9/1987 | Japan . | |

*Primary Examiner*—Daniel O. Crane

*Attorney, Agent, or Firm*—Welsh & Katz, Ltd.

[57] ABSTRACT

The present invention is concerned with a finger tilting apparatus for a transfer feeder which is preferably employable for a transfer press or the like industrial machine so as to allow a finger to be tilted relative to a feed bar. The apparatus includes an angle defining element for defining an angle of rotation of the shaft portion of a finger and an angle stopping element for stopping rotation of the shaft portion of the finger at a rotation angle different from the rotation angle defined by the angle defining element so that the finger is tilted via plural steps.

9 Claims, 15 Drawing Sheets

FINGER TILTING APPARATUS FOR TRANSFER FEEDER

TECHNICAL FIELD

The present invention relates to a finger tilting apparatus for a transfer feeder which is employable for a transfer press or the like machine.

BACKGROUND ART

A transfer feeder equipped on a transfer press is provided with a pair of feed bars arranged in parallel with each other to perform three-dimensional movement by cams, levers or the like members so that a work is clamped by fingers situated at opposing positions of the feed bars so as to allow the work to be transferred between adjacent working stations in a press housing.

Since a commonly used transfer feeder is constructed such that fingers are held immovable relative to feed bars, it is impossible to change the attitude of a work depending upon the shape of a die.

Accordingly, for example, when the work is to be lifted up from the die, a lifting operation can be performed only via a straight track with the result that a lift stroke is unavoidably elongated and thereby it becomes difficult to reduce a time required for transferring the work.

If the shape of the die does not fit the attitude of a work to be clamped by the fingers, the work can not correctly be placed in the die. This means that there is existent a certain restriction with respect to dies which can be put in practical use.

To solve a problem of such inconvenience, a proposal is already disclosed, e.g., in an official gazette of Japanese Utility Model Application NO. 190,222/1975 that fingers are supported to turn relative to feed bars via their shaft portions and a mechanism for rotating the shaft portions is provided to tilt the fingers relative to the feed bars. According to this proposal, a work is correctly placed in a die by adequately tilting the fingers in consideration of the shape of the die and reduction of a lift stroke is achieved by simultaneously performing a lifting operation and a tilting operation Specifically, such a type of conventional finger tilting apparatus includes a plate adapted to be turned in operative association with the shaft portion of a finger, an elongated hole formed in the plate and a defining pin held on a vertical plate firmly secured to a feed bar and slidably fitted in the elongated hole so that a tilt angle of the finger is defined by allowing the defining pin to come in contact with opposite end faces of the elongated hole. With this apparatus of the type including such an elongated hole, the attitude of a work can be changed once only. Thus, for example, in case where a work is clamped while the finger is tilted, a lifting operation and a tilting operation can not simultaneously be performed when the work is to be lifted up (with the exception of a case where the finger is restored to its initial angle).

Further, in case where a tilt angle of the finger is to be changed, this is achieved by selectively fitting the defining pin into one of a plurality of different elongated holes preformed in the plate. Consequently, an attitude of the work can not be changed to an angle rather other than the tilt angles defined by the elongated holes. Thus, a requirement for changing the tilt angle in response to change or modification of the specification given to the work can not be met quickly.

The present invention has been made with the foregoing background in mind and its primary object reside in providing a finger tilting apparatus for a transfer feeder which assures that a finger can be tilted by way of plural steps.

A secondary object of the present invention is to provide a finger tilting apparatus for a transfer feeder which assures that a requirement for changing a tilt angle in response to change or modification of the specification given to a work can be met quickly.

DISCLOSURE OF THE INVENTION

According to one aspect of the present invention, a finger tilting apparatus for a transfer feeder includes means for supporting the shaft portion of a finger for holding a work so as to rotate the shaft portion of the finger relative to a feed bar, means for rotation the shaft portion of the finger, angle defining means for defining an angle of rotation of the shaft portion of the finger and angle stopping means for stopping rotation of the shaft portion of the finger at a rotation angle different from the rotation angle defined by the angle defining means.

With such construction, the rotation angle of the shaft portion of the finger can firmly be defined by the angle defining means after it is defined by the angle stopping means. Thus, even after the finger is once tilted to clamp a work, it can be tilted further when the work is to be later lifted up. Further, a surface of the work to be worked can be changed by changing an attitude of the clamped work prior to a lifting operation, transferring it to a next working station while maintaining the attitude as it is and then changing the attitude assumed by the work during a lowering operation.

According to other aspect of the present invention, a finger tilting apparatus for a transfer feeder includes means for supporting the shaft portion of a finger for holding a work so as to rotate the shaft portion of the finger relative to a feed bar, means for rotating the shaft portion of the finger, an angle defining lever adapted to be turned in operative association with the shaft portion of the finger, an engagement member projected from the angle defining lever in the direction outward of a plane of turning movement of the angle defining lever, a guide member coming in engagement with the engagement member to define turning movement of the angle defining lever and a series of stopper faces and a series of contact faces formed on at least one of the engagement member and the guide member for changing an angle of turning movement of the angle defining lever by allowing the other one of the engagement member and the guide member to be brought in contact with the stopper face and the contact face, wherein at least one of the angle defining lever, the engagement member and the guide member are displaceably arranged to select either of the stopper face and the contact face.

With such construction, turning movement of the angle defining lever can firmly be defined by the contact face after it is defined by the stopper face. Namely, an angle of rotation of the shaft portion of the finger in operative association with turning movement of the angle defining lever can firmly be defined via the contact face after it is defined via the stopper face. Thus, even though the finger is once tilted to clamp the work, it can be tilted further when the work is to be later lifted up. Further, a surface of the work to be worked can be changed by changing the attitude of the clamped work during a lifting operation, transferring it to a next working station while maintaining the changed attitude as it is and then changing the attitude of the work during a lowering operation.

According to another aspect of the present invention, a finger tilting apparatus for a transfer feeder includes means for supporting the shaft portion of a finger for holding a work so as to rotate the shaft portion of the finger relative to a feed bar, means for rotating the shaft portion of the finger, an angle defining lever adapted to be turned in operative association with the shaft portion of the finger and a guide member coming in engagement with the angle defining lever to define turning movement of the angle defining lever, wherein at least one of the angle defining lever and the guide member is continuously displaceably arranged to change an angle of rotation of the shaft portion of the finger.

With such construction, since at least the angle defining lever and the guide member is continuously displaced to change an angle of rotation of the shaft portion of the finger, an angle of rotation of the shaft portion can be defined to an arbitrary angle. Thus, a requirement for changing a tilt angle in response to change or modification of the specification given to a work can be met quickly.

According to further another aspect of the present invention, a finger tilting apparatus for a transfer feeder includes means for supporting the shaft portion of a finger for holding a work, means for rotating the shaft portion of the finger, an angle defining lever adapted to be turned in operative association with the shaft portion of the finger, an engagement lever projected from the angle defining lever in the direction outward of a plane of turning movement of the angle defining lever and a guide member coming in engagement with the engagement member to define turning movement of the angle limiting lever, wherein at least one of the angle defining lever, the engagement lever and the guide member is continuously displaceably arranged to change an angle of rotation of the shaft portion of the finger.

With such construction, at least one of the angle defining lever, the engagement lever and the guide member is continuously displaced to change an angle of rotation of the shaft portion of the finger. Thus, the angle of rotation of the shaft portion of the finger can be defined to an arbitrary angle. Consequently, a requirement for changing a tilt angle in response to change or modification of the specification given to a work can be met quickly.

BRIEF DESCRIPTION OF THE DRAWINGS

FIGS. 1 to 4 show a finger tilting apparatus for a transfer feeder in accordance with a first embodiment of the present invention, respectively, wherein FIG. 1 is a plan view of the apparatus, FIG. 2 is a front view of the apparatus, FIG. 3 is a sectional side view of the apparatus and FIG. 4 is a sectional view of the apparatus taken in line IV—IV in FIG. 1, FIGS. 7 and 8 show a finger tilting apparatus for a transfer feeder in accordance with a third embodiment of the present invention, respectively, wherein FIG. 7 is a front view illustrating essential components for the apparatus and FIG. 8 is a sectional view of the apparatus taken in line VII—VII in FIG. 7, FIGS. 10 to 12 show a finger tilting apparatus for a transfer feeder in accordance with a fifth embodiment of the present invention, respectively, wherein FIG. 10 is a plan view of the apparatus, FIG. 11 is a front view of the apparatus and FIG. 12 is a sectional side view of the apparatus, FIGS. 14 to 16 show a finger tilting apparatus for a transfer feeder in accordance with a sixth embodiment of the present invention, respectively, wherein FIG. 14 is a plan view of the apparatus, FIG. 15 is a front view of the apparatus and FIG. 16 is a sectional side view of the apparatus.

BEST MODE FOR CARRYING OUT THE INVENTION

Figure 1:
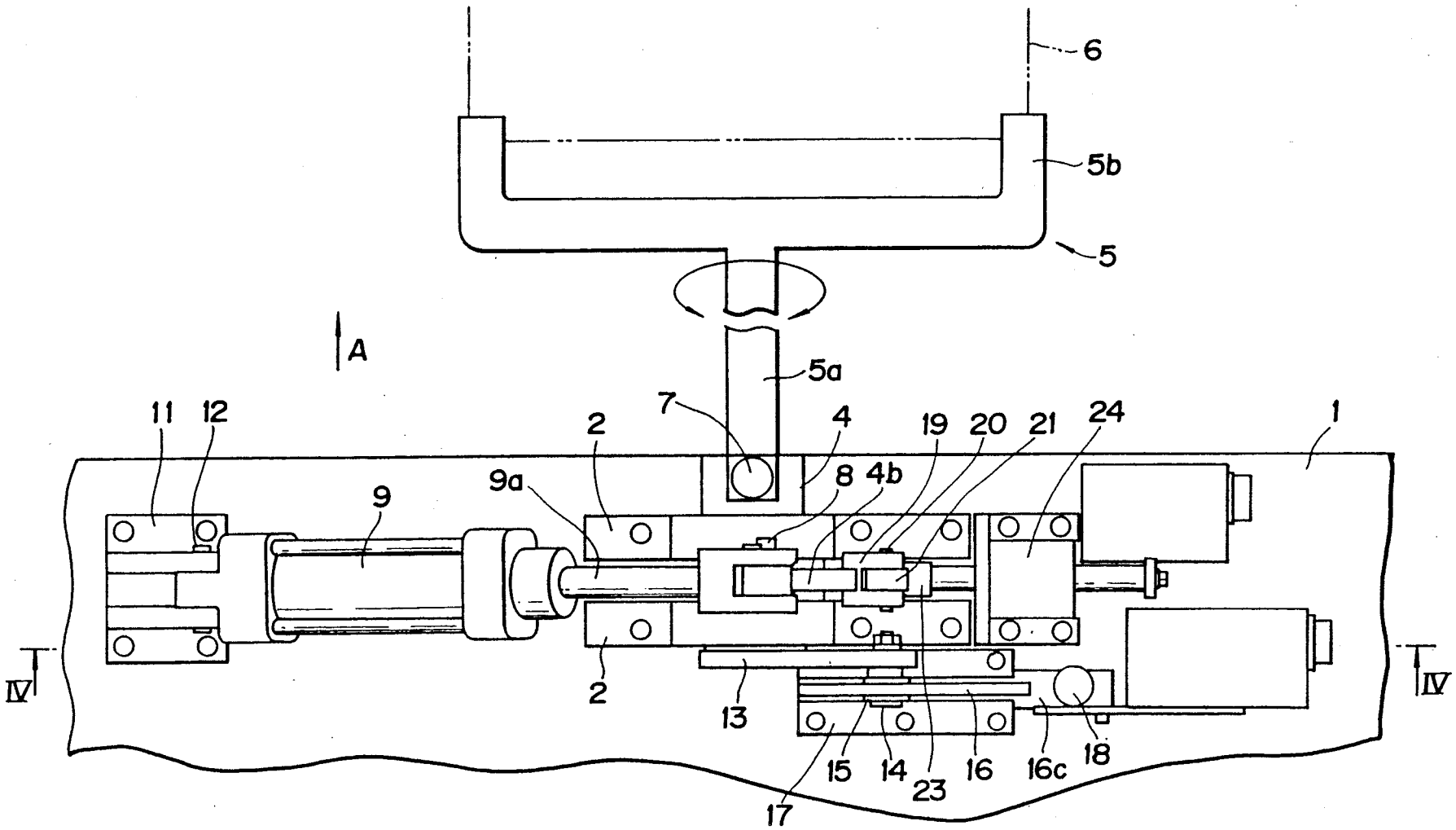

Now, the present invention will be described in detail hereinafter with reference to the accompanying drawings which illustrate preferred embodiments thereof.

FIGS. 1 to 5 diagramatically illustrate a finger tilting apparatus for a transfer feeder in accordance with a first embodiment of the present invention, respectively.

The transfer feeder as exemplified in the drawings includes a pair of feed bars (not clearly shown in the drawings) arranged in parallel with each other to perform their three-dimensional movement in operative association with cams, lever and other members so that fingers are located opposite to each other at plural opposing positions assumed by the feed bars by means of a plurality of finger tilting apparatuses. Since the finger tilting apparatuses are identical to each other in structure, only one of them will typically be described in more details in the following.

Figure 3:
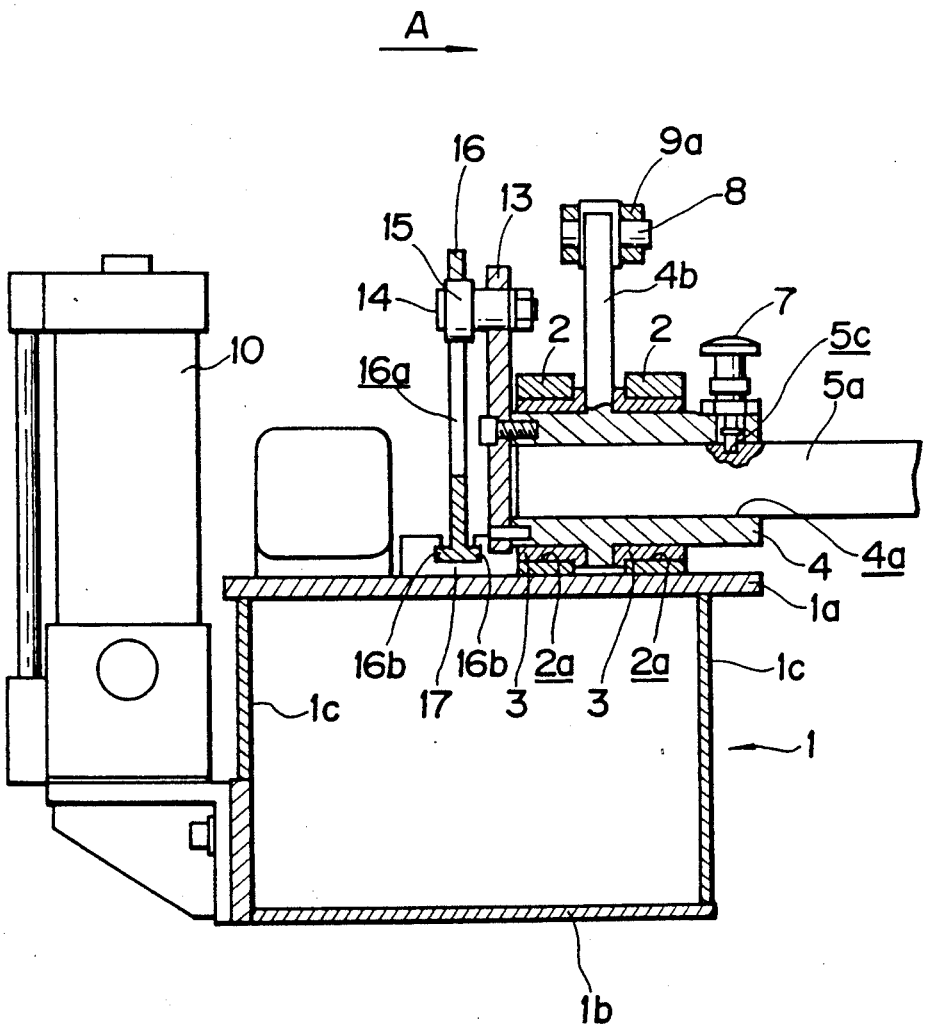

As shown in FIG. 3, the feed bar 1 is constructed in a long coulmn-shaped structure having a rectangular cross-sectional shape which comprises an upper plate 1*a*, a lower plate 2*b* and a pair of side plates 1*c* by way of which the upper plate 1*a* and the lower plate 1*b* are connected to each other, and a pair of brackets 2 are fixedly mounted on the upper plates 1*b*. The brackets 2 are disposed at positions offset from the longitudinally extending center line of the feed bar 1 in the direction toward a position assumed by another feed bar which is not shown in the drawings (in the direction of an arrow mark A in the drawing). Incidentally, the direction toward a position where another feed bar is disposed is hereinafter referred to as "inward of the feed bar 1". As is apparent from the drawing, the brackets 2 are spaced from each other in the transverse direction of the feed bar 1, and bearing holes 2*a* are formed at the central positions on the brackets 2 in such a manner that their axial centers are located in alignment with each other in the transverse direction of the feed bar 1. A finger holding member 4 is rotatably inserted through the bearing holes 2*a* across the both brackets 2 while bushes 3 are interposed between the both brackets 2 and the finger holding member 4. As shown in the drawing, opposite ends of the the finger holding member 4 are projected outward of the brackets 2 and one of the opposite ends located inside of the feed bar 1 is situated above the side end of the upper plate 1*a*.

Figure 4:
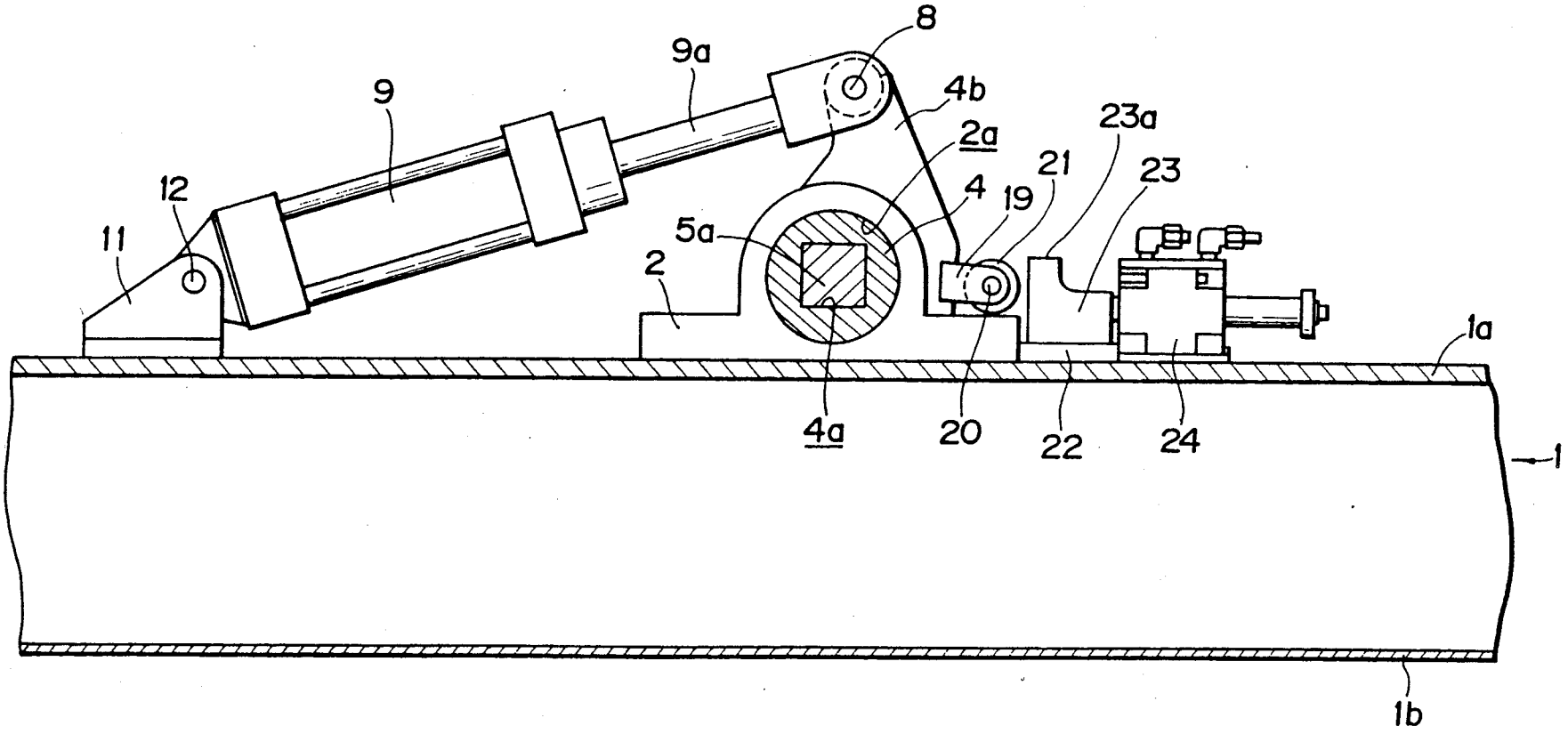

Referring to FIG. 4, the finger holding member 4 is formed with a substantially square fitting hole 4*a* at its central part so that the shaft portion 5*a* of a finger 5 is removably fitted through the fitting hole 4*a*. As shown in FIG. 1, the finger 5 includes clamp portions 5*b* for clamping a work 6, at the fore end of the shaft portion 5*a* having a substantially square cross-sectional shape. Thus, the finger 5 is operatively connected to the holding member 4 in such a manner that the clamp portions 5*b* are inward of the inner end of the finger holding member 4 on the feed bar 1. In FIGS. 1 and 3, reference numeral 7 designates a stopper pin of which fore end comes in and out of the fitting hole 4*a* of the finger holding member 4. Once the fore end of the stopper pin 7 is fitted into an engagement hole 5*c* on the shaft portion 5*a* of the finger 5, this inhibits the finger 5 from moving away from the finger holding member 4.

Figure 2:
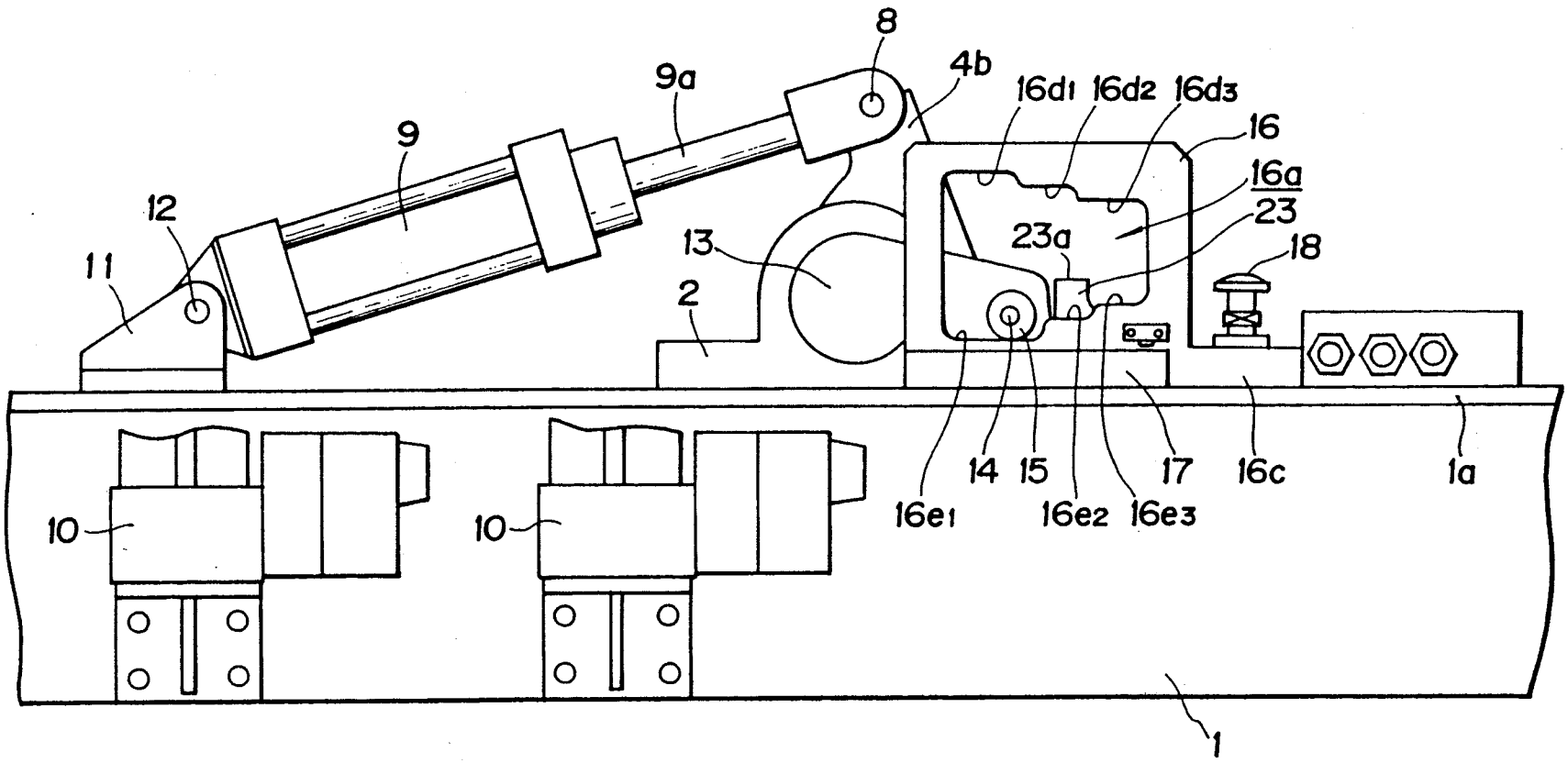

Further, the finger holding member 4 is provided with a turn lever 4*b* at a position between the pair of brackets 2. The turn lever 4*b* made integral with the finger holding member 4 extends in the radial direction from the outer periphery of the finger holding member 4, and the actuating rod 9*a* of a cylinder actuator 9 is pivotally connected to the fore end of the turn lever 4*b* via a pin 8. The cylinder actuator 9 is actuated by hydraulic pressure which has been converted from pneumatic pressure in air-hydro cylinders 10 as shown in FIGS. 2 and 3. As is apparent from FIG. 1, the cylinder actuator 9 is arranged in the longitudinal direction of the feed bar 1 and its bottom end is pivotally supported on the upper plate 1*a* of the feed bar 1 via a bracket 11 and a pin 12.

As shown in FIG. 3, the finger tilting apparatus is provided with an angle defining lever 13 along the outer end face of the finger holding member 4 on the feed bar 1. As is best seen in FIG. 2, the angle defining lever 13 extends in the radial direction of the finger holding lever 4 from a position different from that of the turn lever 4*b*, and a roller 15 (serving as an engagement member) is turnably carried at the fore end of the angle defining lever 13. As shown in FIG. 3, the roller 15 is projected outward of the outer end of the angle defining lever 13 relative to the feed lever 1 in the direction at right angles relative to the direction of extension of the angle defining lever 13, and the peripheral surface of the roller 15 is accommodated within the cut-out 16*a* of a guide member 16. The guide member 16 includes a pair of projections 16*b* on both sides of its lower end so that it slidably moves in the longitudinal direction of the feed bar 1 while the projections 16*b* are slidably engaged with a rail member 17 mounted on the upper plate 1*a* of the feed bar 1 at a position outside of the angle defining lever 13. Further, as shown in FIG. 2, the guide member 16 includes a position determining portion 16*c* extending in the longitudinal direction of the feed bar 1 and a position determining pin 18 mounted on the position determining portion 16*c* so that a position to be assumed by the guide member 16 as seen in the longitudinal direction of the feed bar 1 can be changed by way of three steps by selectively fitting the position determining pin 18 into a certain position determining hole (not shown) on the rail member 17.

In addition, the guide member 16 is formed with three contact faces $16d_1$, $16d_2$ and $16d_3$ along the upper inner edge of the cut-out 16*a* and another three contact faces $16e_1$, $16e_2$ and $16e_3$ along the lower inner edge of the cut-out 16*b*. The contact faces $16d_1$, $16d_2$ and $16d_3$ and the contact faces $16e_1$, $16e_2$ and $16e_3$ are continuously formed one after another in the longitudinal direction of the feed bar 1 and they are located at positions to be assumed by the roller 15 in response to variation of the position of the guide member 16 by way of three steps.

As shown in FIG. 1, the finger tilting apparatus is provided with a stop lever 19 at a certain position between the brackets 2 on the finger holding member 4. The stop lever 19 extends in the same direction as that of extension of the angle defining lever 13, and as shown in FIG. 4, a roller 21 is rotatably supported at the fore end of the stop lever 19 via a pin 20.

Further, as shown in FIG. 4, the finger tilting apparatus is provided with a rail member 22 at a certain position between the brackets 2 on the upper plate 1*a* of the feed bar 1. The rail member 22 extends from a position outward of the brackets 2 to a position corresponding to the roller 21 of the stop lever 19 and a stopper member 23 is displaceably mounted on the rail member 22 at the last-mentioned position. The stopper member 23 has a stopper face 23*a* formed thereon and it is forwardly and backwardly displaced in the longitudinal direction of the feed bar 1 by actuating a thin walled-type cylinder actuator 24 firmly mounted on the upper plate 1*a* of the feed bar 1, while the stopper face 23*a* is directed upwardly. It should be noted that as shown in FIG. 2, a height of the stopper face 23*a* of the stopper member 23 measured from the upper plate 1*a* of the feed bar 1 is determined such that it does not coincide with a height of each of the contact faces $16d_1$, $16d_2$, $16d_3$, $16e_1$, $16e_2$ and $16e_3$ in the guide member 16 measured from the upper plate 1*a* of the feed bar 1 but it resides between a minimum value among heights of the contact faces $16d_1$, $16d_2$ and $16d_3$ on the upper peripheral edge of the cut-out 16*a* of the guide member 16 (representing a height of the contact face $16d_3$ in the illustrated embodiment) and a maximum height among the heights of the abutment faces $16e_1$, $16e_2$ and $16e_3$ of the same (representing a height of the abutment face $16e_3$ in the illustrated embodiment).

With the finger tilting apparatus as constructed in the above-described manner, when the cylinder actuator 9 is actuated to displace an actuating rod 9*a* in forward and rearward directions, the finger holding lever 4 is turned via the turn lever 4*b* and, as the finger holding member 4 is turned in that way, the angle defining lever 13 and the stop lever 19 are turned correspondingly, whereby the shaft portion 5*a* of the finger 5 operatively coupled to the finger holding member 4 is rotated about the axis of the shaft portion 5*a* of the finger 5.

Figure 5:
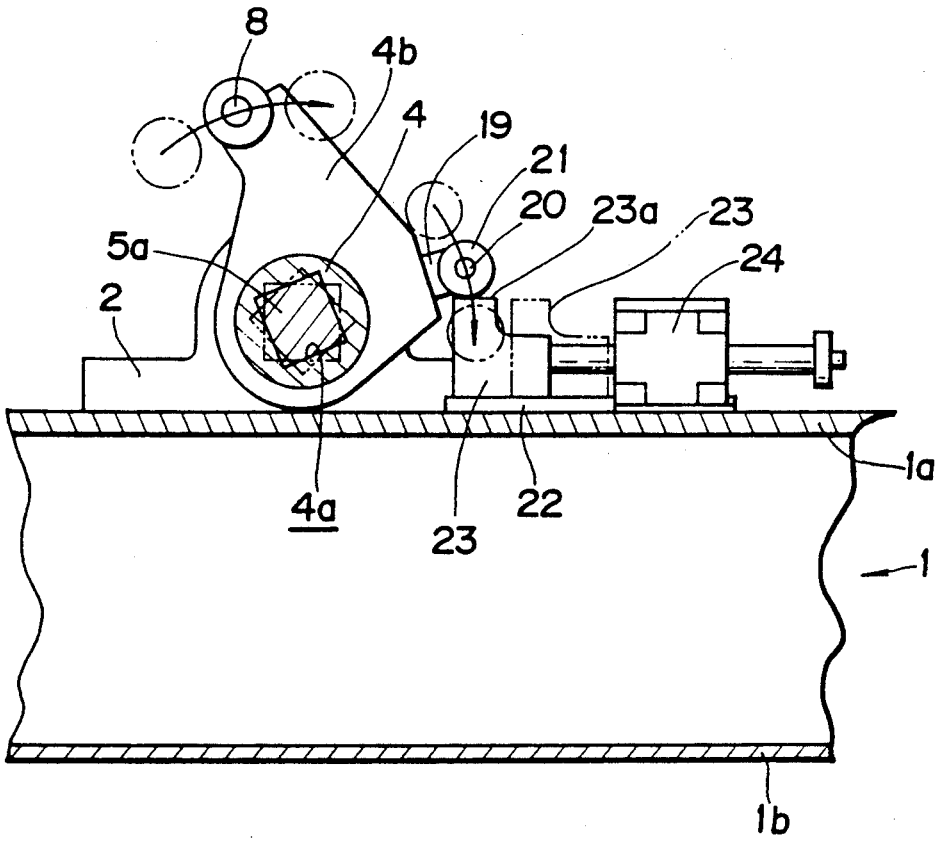
FIG. 5 is a sectional front view illustrating by way of example an operation of the apparatus in accordance with the first embodiment.

Next, when the cylinder actuator 9 is actuated while the stopper member 23 is located in a region of movement of the roller 21 by actuating the cylinder actuator 24 in response to turning movement of the stopper lever 19 and the roller 15 on the angle defining lever 13 is held in contact with the contact face $16d_1$ on the upper peripheral edge of the cut-out 16*a* of the guide member 16, the roller 21 is first brought in contact with the stopper face 23*a* of the stopper member 23 by turning movement of the stop lever 19 until turning movement of the stop lever 19 is defined, and an angle of turning movement of the shaft portion 5*a* of the finger 5 is then defined via the stop lever 19 and the finger holding member 4, as shown in FIG. 5.

Thereafter, when the cylinder actauator 24 is actuated to rearwardly displace the stopper member 23 to a position as represented by two-dot chain lines in FIG. 5, i.e., a position outside of the region of movement of the roller 21, the shaft portion 5*a* of the finger 5 is turned further in the same direction by means of the cylinder actuator 9. As the shaft portion 5*a* is rotated in that way, the roller 15 on the angle defining lever 13 is brought in contact with the contact face $16e_1$ on the lower peripheral edge of the cut-out 16*a* of the guide member 16, whereby turning movement of the angle defining lever 13 is defined and an angle of turning movement of the shaft portion 5*a* of the finger 5 is also defined via the angle defining lever 13 and the finger holding member 4.

Next, when the cylinder actuator 9 is actuated in the opposite direction from the aforementioned state, the roller on the angle defining lever 13 is brought in contact with the contact face $16d_1$ on the upper peripheral edge of the cut-out 16*a* of the guide member 16, whereby turning movement of the angle defining lever 13 is defined and the shaft portion 5*a* of the finger 5 is restored to the initial turning angle via the angle defining lever 13 and the finger holding member 4.

Namely, when the finger tilting apparatus of the present invention is used, the finger 5 is first tilted by an angle corresponding to an angle of turning movement of the stop lever 19 which has been defined by the stopper face 23*a* of the stopper member 23 and thereafter it is turned further by an angle corresponding to an angle of turning movement of the angle defining lever 13 which has been defined by the contact face $16e_1$ of the guide member 16.

Consequently, the work placed in a die can reliably be clamped by tilting the finger 5, and even after the work is clamped, a lifting operation and a tilting operating can simultaneously be performed with the result that a stroke of the lifting operation can be shortened.

In addition, in case where the work is clamped while the finger 5 is restored to the initial angle, an attitude to be assumed by the work can be changed by way of two steps.

Further, with the finger tilting apparatus in accordance with the first embodiment of the present invention, a position to be assumed by the guide member 16 can be changed by selectively changing the fitting hole in which the position determining pint 18 is fitted and thereby an initial angle of the shaft portion 5*a* of the finger 5 and an angle of rotation the same can be changed from the contact faces $16d_1$ and $16e_1$ to another combination of the contact faces $16d_2$ and $16e_2$ or the contact faces $16d_3$ and $16e_3$ on the guide member 16 with which the roller 15 on the angle defining lever 13 is to comes in contact.

If a structural modification is made such that the stopper member 23 is formed with a plurality of stopper faces, an attitude to be assumed by the work 6 can be changed by way of plural steps.

Figure 6:
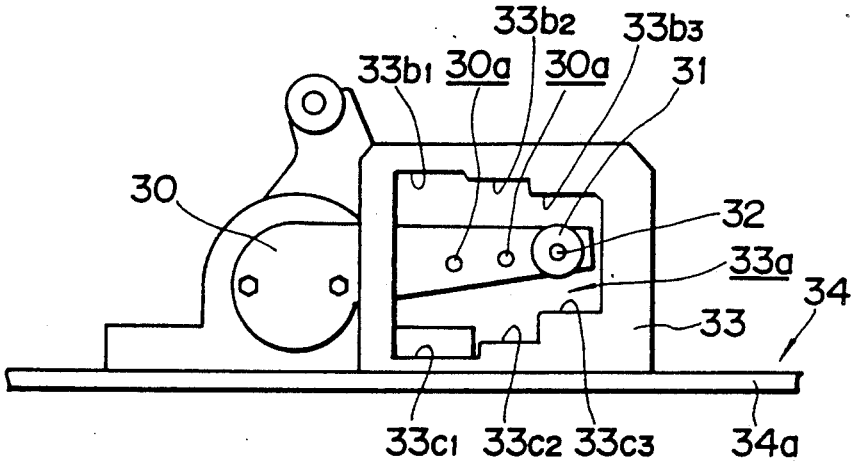
FIG. 6 is a front view illustrating essential components constituting a finger tilting apparatus for a transfer feeder in accordance with a second embodiment of the present invention.

FIG. 6 diagramatically illustrates essential components constituting a finger tilting apparatus for a transfer feeder in accordance with a second embodiment of the present invention. A different point of this embodiment from the first embodiment consists only in a structure for defining turning movement of an angle defining lever.

Specifically, according to the second embodiment, the angle defining lever 30 is formed with a plurality of fitting holes 30*a* so that a roller 31 is displaced relative to the angle defining lever 30 by selectively fitting a pin 32 for the roller 31 (serving as an engagement portion) into one of the fitting holes 30*a*.

On the other hand, a guide member 33 is firmly mounted on the upper plate 34*a* of a feed bar 34 and a cut-out 33*a* of the guide member 33 has contact faces $33b_1$, $33b_2$ and $33b_3$ along the upper peripheral edge of the cut-out 33*a* and contact faces $33c_1$, $33c_2$ and $33c_3$ along the lower peripheral edge of the same which are arranged one after another in the direction of movement of the roller 31 in a step-shaped configuration.

According to the second embodiment, turning movement of the angle defining lever 30 is defined by coming the roller 31 on the angle defining lever 30 in contact with contact faces on the guide member 33, e.g., the contact faces $33b_3$ and $33c_3$ and thereby an angle of rotation of the shaft portion of a finger (not shown) is defined. Thus, an initial angle of the shaft portion of the finger and an angle of rotation of the same can be varied by displacing the roller 31 to change the contact faces $33b_3$ and $33c_3$ on the guide member 33 to another combination of the contact faces $33b_1$ and $33c_1$ or $33b_2$ and $33c_2$ on the guide member 33 with which the roller 31 is to be brought in abutment.

In the second embodiment, even in case where the contact faces on the guide member 33 are designed in a flat contour, a practical arm length of the angle defining lever 30 is varied as the roller 31 is displaced, whereby an initial angle of the shaft portion of the finger and an angle of rotation of the same are changed correspondingly.

Figure 7:
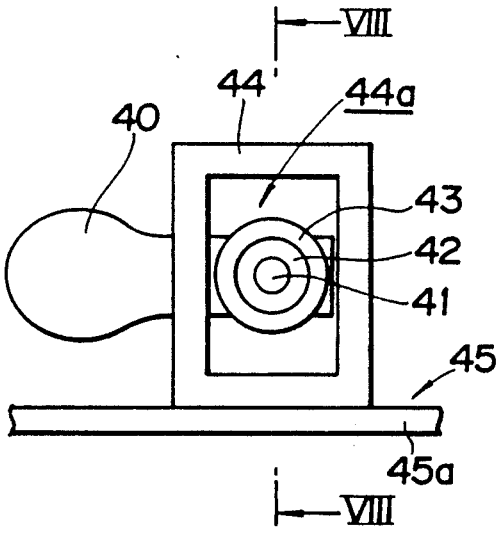
Figure 8:
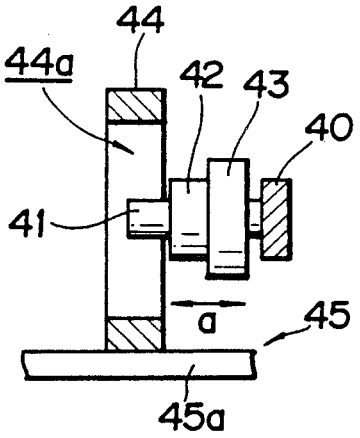

FIGS. 7 and 8 schematically illustrate essential components constituting a feed tilting apparatus for a transfer feeder in accordance with a third embodiment of the present invention. A different point of this embodiment from the first embodiment consists only in a structure for limiting turning movement of an angle defining lever.

Specifically, according to the third embodiment, as is apparent from FIG. 8, the angle defining lever 40 is provided with a plurality of rollers 41, 42 and 43 (serving as an engagement roller) each having a different diameter, and the rollers 41, 42 and 43 are arranged to move in the direction outward of a plane of turning movement of the angle defining lever 40 (in the direction of arrow marks a in the drawing).

On the other hand, a guide member 44 is firmly mounted on an upper plate 45*a* of a feed bar 45. In this embodiment, a cut-out 44*a* of the guide member 44 is designed in a rectangular contour, as shown in FIG. 7.

According to the third embodiment, turning movement of the angle defining lever 40 is defined by bringing a certain roller on the angle defining lever 40, e.g., the roller 41 in contact with the inner peripheral edge of the cut-out 44*a* of the guide member 44, whereby an angle of rotation of the shaft portion of a finger (not shown) is defined. Specifically, an initial angle of the shaft portion and an angle of turning movement of the same can be changed by displacing the rollers 41, 42 and 43 to change the roller 41 to another roller 42 or 43 which is to be brought in contact with the inner peripheral edge of the cut-out 44*a* of the guide member 44.

In the third embodiment, even in case where the rollers 41, 42 and 43 are immovably held on the angle defining lever 40 and the guide member 44 is displaceably arranged, an initial angle of the shaft portion of the finger and an angle of rotation of the same can be changed in the same manner as mentioned above.

Figure 9:
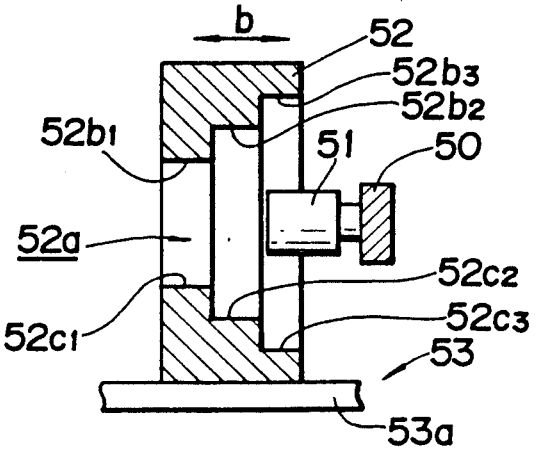
FIG. 9 is a sectional side view illustrating essential components constituting a finger tilting apparatus for a transfer feeder in accordance with a fourth embodiment of the present invention.

FIG. 9 schematically illustrates a finger tilting apparatus for a transfer feeder in accordance with a fourth embodiment of the present invention. A different point of this embodiment from the first embodiment consists only in a structure for limiting the turning movement of an angle defining lever.

Specifically, according to the fourth embodiment, the angle defining lever 50 is provided with a roller 51 (serving as an engagement member) projected outward of a plane of turning movement of the angle defining lever 50 (in the direction of arrow marks b in the drawing), and a guide member 52 is mounted on the upper plate 53*a* of a feed bar 53 so as to move in the direction of projection of the roller 51.

The guide member 52 is formed with a cut-out 52*a* which has contact faces $52b_1$, $52b_2$ and $52b_3$ along the upper peripheral edge and contact faces $52c_1$, $52c_2$ and $52c_3$ along the lower peripheral edge thereof which are arranged one after another in the direction of movement of the guide member 52 in a step-shaped contour.

According to the fourth embodiment, turning movement of the angle defining lever 50 is defined by bringing the roller 51 of the angle defining lever 50 in contact with certain contact faces on the guide member 52, e.g., the contact faces $52b_3$ and $52c_3$, whereby an angle of rotation of the shaft portion of a finger (not shown) is defined. Further, an initial angle of the shaft portion and an angle of rotation of the same are varied by displacing the guide member 52 to change the contact faces $52b_3$ and $52c_3$ to another combination of the contact faces $52b_1$ and $52c_1$ or $52b_2$ and $52c_2$ with which the roller 51 is to come in contact.

In the fourth embodiment, even in case where the roller 51 is arranged so as to move in the direction of projection thereof relative to the angle defining lever 50 and the guide member 52 is immovably mounted on the feed bar 53, an initial angle of the shaft portion and an angle of rotation of the same can be changed in the same manner as mentioned above.

FIGS. 10 to 13 diagramatically show a finger tilting apparatus for a transfer feeder in accordance with a fifth embodiment of the present invention, respectively.

The transfer feeder as exemplified in the drawings is provided with a pair of feed bars arranged in parallel with each other to perform their three-dimensional movement in operative association with cams, levers and other members in the same manner as in the first embodiment so that fingers are located opposite to each other at plural opposing positions assumed by the feed bars via a plurality of finger tilting apparatus. Since the finger tilting apparatuses are identical to each other in structure, only one of them will typically be described in more details in the following.

Figure 12:
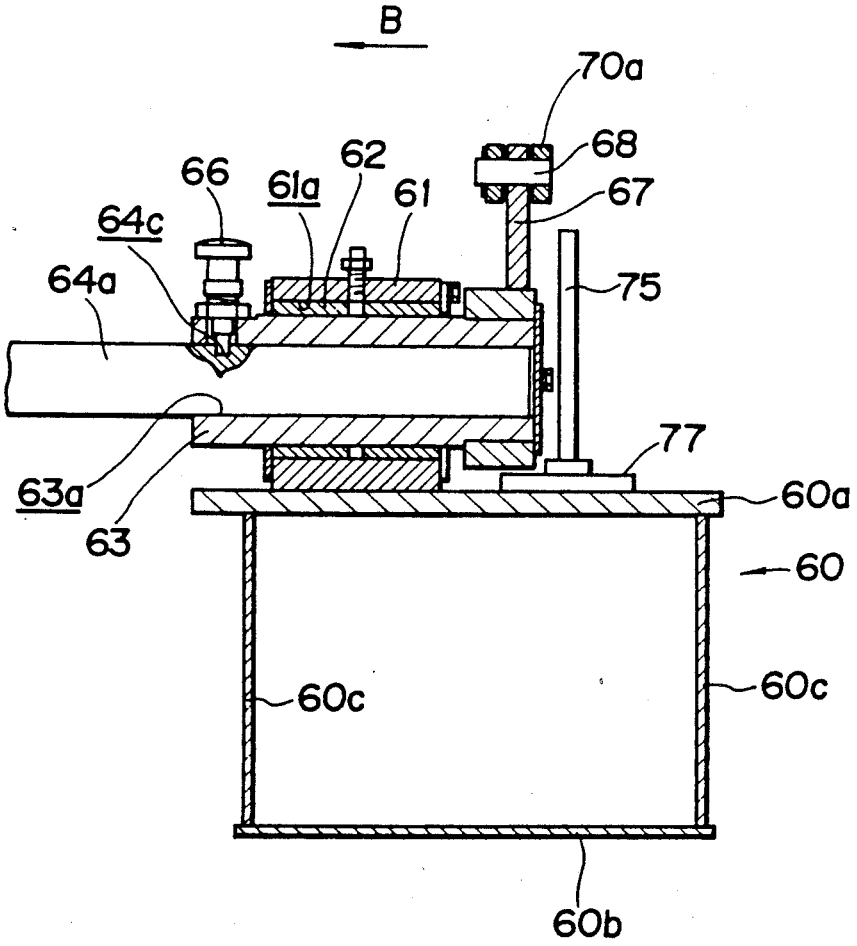

As shown in FIG. 12, the feed bar 1 is constructed in a long column-shaped structure having a rectangular cross-sectional shape which comprises an upper plate 60*a*, a lower plate 60*b* and a pair of side plates 60*c* by way of which the upper plate 60*a* and the lower plate 60*b* are connected to each other, and a pair of brackets 61 are fixedly mounted on the upper plate 60*a*. The brackets 61 are disposed at positions offset from the longitudinally extending center line of the feed bar 60 in the direction toward a position assumed by another feed bar which is not shown in the drawings (in the direction of an arrow mark B in the drawing). Incidentally, the direction toward a position where another feed bar is disposed is hereinafter referred to as "inward of the feed bar 60". As is apparent from the drawing, bearing holes 61*a* are formed at the central parts of the brackets 61 in such a manner their axial centers are located in alignment with each other in the transverse direction of the feed bar 60, and a finger holding member 63 is rotatably inserted through the bearing holes 61*a* while bushes 62 are interposed between the brackets 61 and the finger holding member 63. As shown in the drawing, opposite ends of the finger holding member 63 are projected outward of the brackets 61 and one of the 5 opposite ends located inside of the feed bar 60 is situated above the side end of the upper plate 60*a*.

Figure 10:
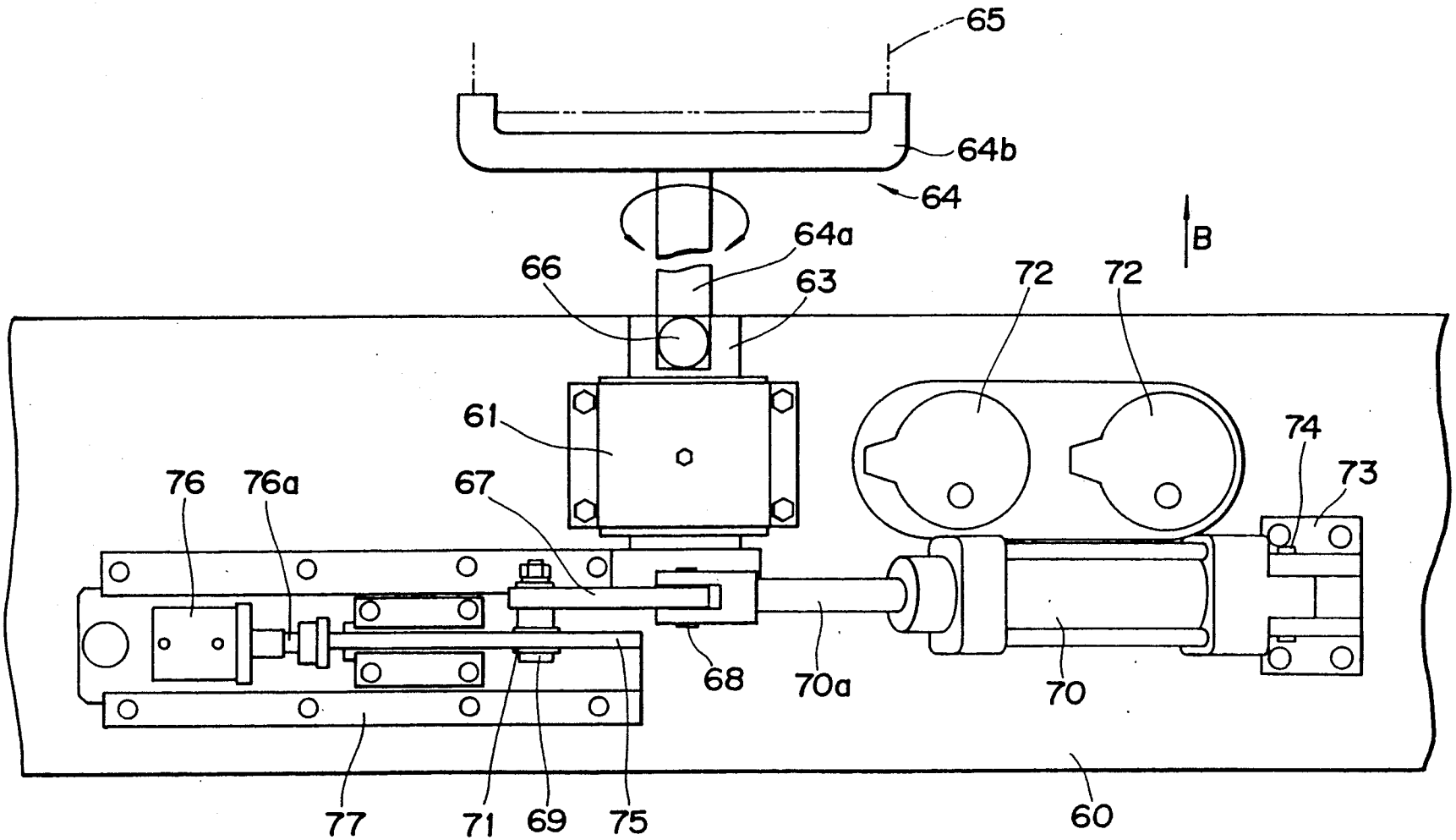
Figure 11:
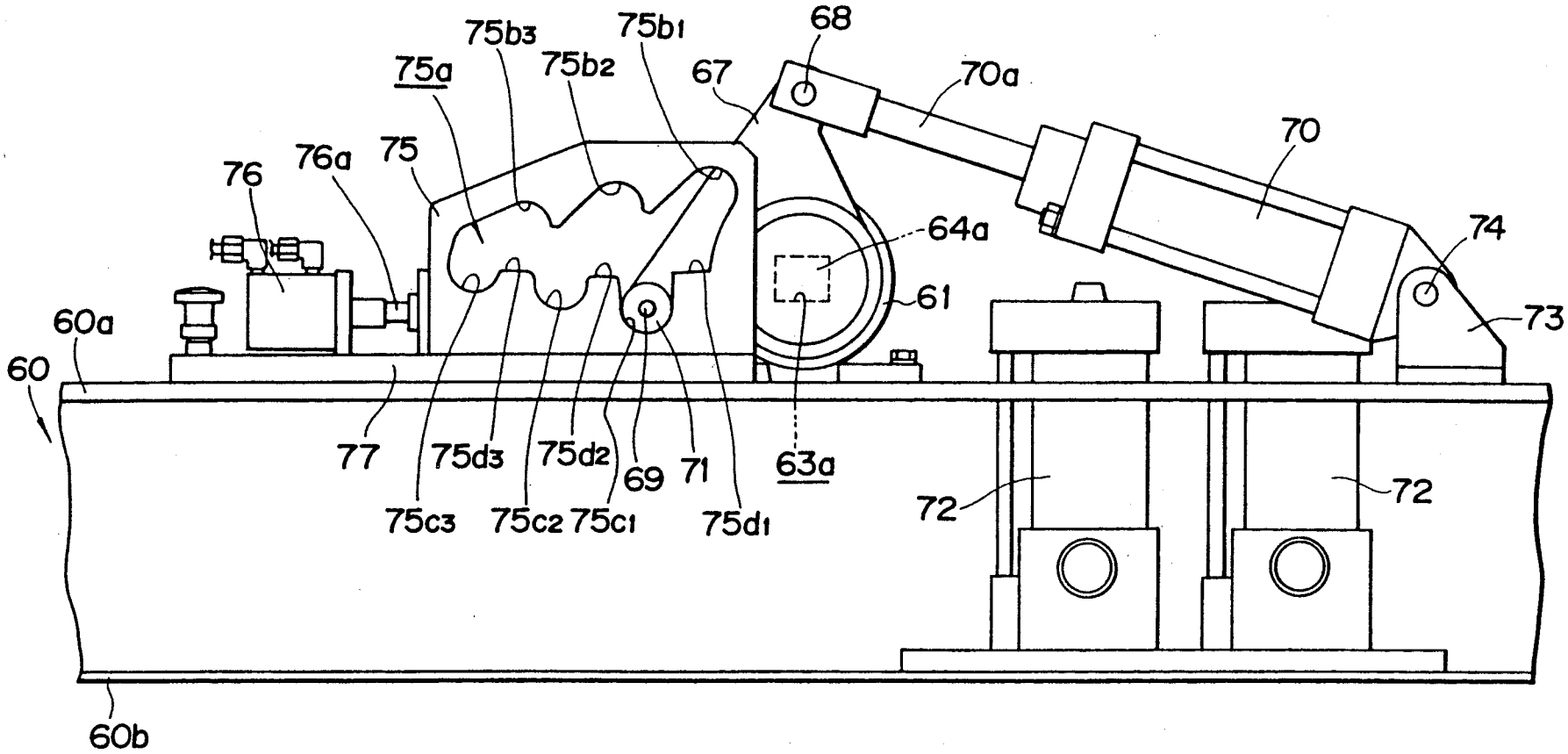

Referring to FIG. 11, the finger holding member 63 is formed with a rectangular fitting hole 63*a* at its central part so that the shaft portion 64*a* of a finger 64 is removably fitted through the fitting hole 63*a*. As shown in FIG. 10, the finger 64 includes clamp portions 64*b* for clamping a work 65, at the fore end of the shaft portion 64*a* having a rectangular cross-sectional shape so that it is operatively connected to the finger holding member 63 in such a manner that the clamping portions 64*b* are projected inward of the side end of the finger holding member 63 situated above the feed bar 60. In FIGS. 10 and 12, reference numeral 66 designates a stopper pin of which fore end comes in and out of a fitting hole 63*a* in the finger holding member 63. When the fore end of the stopper pin 66 is engaged with an engagement hole 64*c* on the shaft portion 64*a* of the finger 64, this inhibits the finger 64 from being disconnected from the finger holding member 63.

As shown in FIG. 12, the finger tilting apparatus is provided with an angle defining lever 67 at one end of the finger holding member 63 above the feed bar 60 so as to allow the angle defining lever 67 to be turned in operative association with the finger holding member 63. As is best seen in FIG. 11, the angle defining lever 67 is provided with pins 68 and 69 at two different positions in the outer peripheral region of the finger holding member 63 such that the actuating rod 70*a* of a cylinder actuator 70 is coupled to the one pin 68 and a roller 71

(serving as an engagement member) is carried on the other pin 69.

The cylinder actuator 70 is actuated by hydraulic pressure which has been converted from air pressure using air-hydro cylinders 72 as shown in FIGS. 10 and 11. As is apparent from FIG. 10, the cylinder actuator 70 is arranged in the longitudinal direction of the feed bar 60 and its bottom end is pivotally supported on the upper plate 60*a* of the feed bar 60.

The roller 71 is projected from a plane of the angle defining lever 67 situated on the outside of the feed bar 60 in the direction at right angles relative to the direction of extension of the angle defining lever 67 and its outer peripheral surface is accommodated in a cut-out 75*a* of the guide member 75. The bottom end of the guide member 75 is coupled to the actuating rod 76*a* of a thin-walled type cylinder actuator 76 so that the guide member 75 is displaced in the longitudinal direction of the feed bar 60 along a rail member 77 mounted on the upper plate 60*a* of the feed bar 60.

As shown in FIG. 11, the guide member 75 is formed with three contact faces $75b_1$, $75b_2$ and $75b_3$ and another three contact faces $75c_1$, $75c_2$ and $75c_3$ each having a different height measured from the upper plate 60*a* of the feed bar 60, along the upper and lower peripheral edges of the cut-out 75*a*. The respective contact faces $75b_1$, $75b_2$, $75b_3$, $75c_1$, $75c_2$ and $75c_3$ are designed in an elongated hole-shaped contour having the same radius as that of the roller 71 and a group of the contact faces $75b_1$, $75b_2$ and $75b_3$ and another group of the contact faces $75c_1$, $75c_2$ and $75c_3$ are continuously arranged one after another in the longitudinal direction of the feed bar 60.

In addition, the guide member 75 is formed with stopper faces $75d_1$, $75d_2$ and $75d_3$ within the cut-out 75*a*. The respective stopper faces $75d_1$, $75d_2$ and $75d_3$ are designed in a flat contour and reside between the contact faces $75b_1$, $75b_2$ and $75b_3$ on the upper side and the contact faces $75c_1$, $75c_2$ and $75c_3$ on the lower side of the cut-out 75*a*. The contact faces $75b_1$, $75b_2$ and $75b_3$ and the contact faces $75c_1$, $75c_2$ and $75c_3$ are continuously formed one after another.

As is apparent from the drawings, the contact faces $75b_1$, $75b_2$ and $75b_3$ on the upper side of the cut-out 75*a* and the stopper faces $75d_1$, $75d_2$ and $75d_3$ are situated within a region of movement of the roller 71 performed by turning movement of the angle defining lever 67, and the contact faces $75c_1$, $75c_2$ and $75c_3$ on the lower side of the cut-out 75*a* are situated at positions offset leftward of the region of movement of the roller 71 corresponding to the contact faces $75b_1$, $75b_2$ and $75b_3$.

With the finger tilting apparatus as constructed in the above-described manner, when the cylinder actuator 70 is actuated to displace the actuator rod 70*a* in forward and rearward directions, the finger holding member 63 is rotated via the angle defining lever 67 and thereby the shaft portion 64*a* of the finger 64 operatively connected to the finger holding member 63 is rotated about the axis of rotation thereof.

Figure 13:
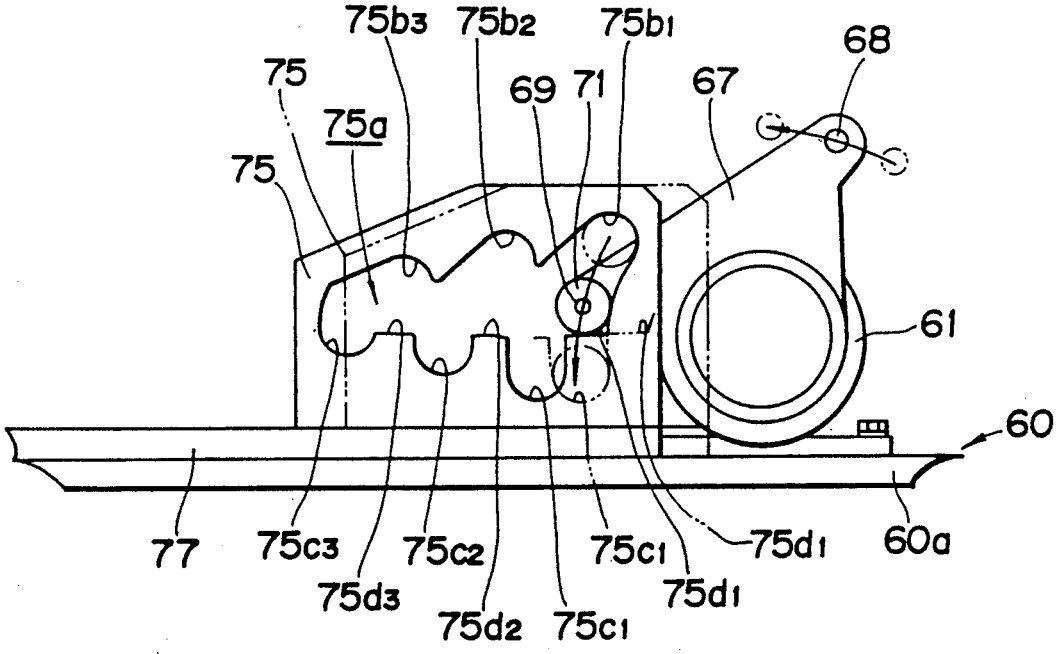
FIG. 13 is a front view of essential components illustrating by way of example an operation of the apparatus in accordance with the fifth embodiment of the present invention.

Now, it ia assured that the thin walled-type cylinder actuator 76 is actuated and the cylinder actuator 70 is actuated from the state that the roller 71 on the angle defining lever 67 is brought in contact with the contact face $75b_1$ on the upper side of the guide member 75, as shown in FIG. 13. First, as the angle defining lever 67 is turned, the roller 7 is brought in contact with the stopper face $75d_1$, whereby turning movement of the angle defining lever 67 is defined and an angle of rotation of the shaft portion 64*a* of the finger 64*a* is then defined via the angle defining lever 67 and the finger holding member 63.

Thereafter, when the cylinder actuator 76 is actuated to displace the guide member 75 in the rightward direction as seen in FIG. 13, the shaft portion 64*a* is rotated further in the same direction by actuating the cylinder actuator 70. As the shaft member 64*a* is rotated in that way, the roller 71 is brought in contact with the contact face $75c_1$ on the lower side of the guide member 75, whereby turning movement of the angle defining lever 67 is defined and an angle of rotation of the shaft portion 64*a* is then defined via the angle defining lever 67 and the finger holding member 63.

Namely, while the finger 64 is held in the operative state as mentioned above, it is first tilted by an angle corresponding to an angle of turning movement of the angle defining lever 67 of which movement is now defined by the stopper face $76d_1$, and thereafter it is tilted by an angle corresponding to an angle of turning movement of the angle defining lever 67 of which movement is now defined by the contact face $75c_1$ on the lower side of the cut-out 75*a*.

Consequently, the work placed in a die can reliably be clamped by tilting the finger 64 and after the work has been clamped in that way, a lifting operation and a tilting operation can simultaneously be performed with the result that a lift stroke can be shortened. Further, a surface of the work to be worked can be changed by changing an attitude of the clamped work during a lifting operation, transferring the work to a next working station while maintaining its attitude as it is and then changing the attitude of the work during a lowering operation.

With the finger tilting apparatus in an accordance with the fifth embodiment of the present invention, a position assumed by the guide member 75 can be changed by actuating the cylinder actuator 76 and moreover an initial angle of the shaft portion 64*a* of the finger 64 and an angle of rotation of the same can be changed by changing the contact faces $75b_1$ and $75c_1$ to another combination of the contact faces $75b_2$ and $75c_2$ or the contact faces $75b_3$ and $75c_3$ with which the roller 71 is to come in contact.

According to the fifth embodiment, an attitude of the work 65 can be changed by way of plural steps by providing a plurality of stopper faces between the contact face $75b_1$ ($75b_2$, $75b_3$) on the upper side of the guide member 75 and the contact face $75c_1$ ($75c_2$, $75c_3$) on the lower side of the same.

Further, according to the fifth embodiment, the guide member 75 is displaceably mounted and the stopper faces $75d_1$, $75d_2$ and $75d_3$, the contact faces $75b_1$, $75b_2$ and $75b_3$ and the contact faces $75c_1$, $75c_2$ and $75c_3$ are formed in the guide member 75. Alternatively, these stopper faces and contact faces may be formed on the roller 71 and at least one of the roller 71 and the angle defining lever 67 may be displaced in the direction of continuation of the stopper faces and the contact faces with the same advantageous effects as those in the preceding embodiments.

Figure 14:
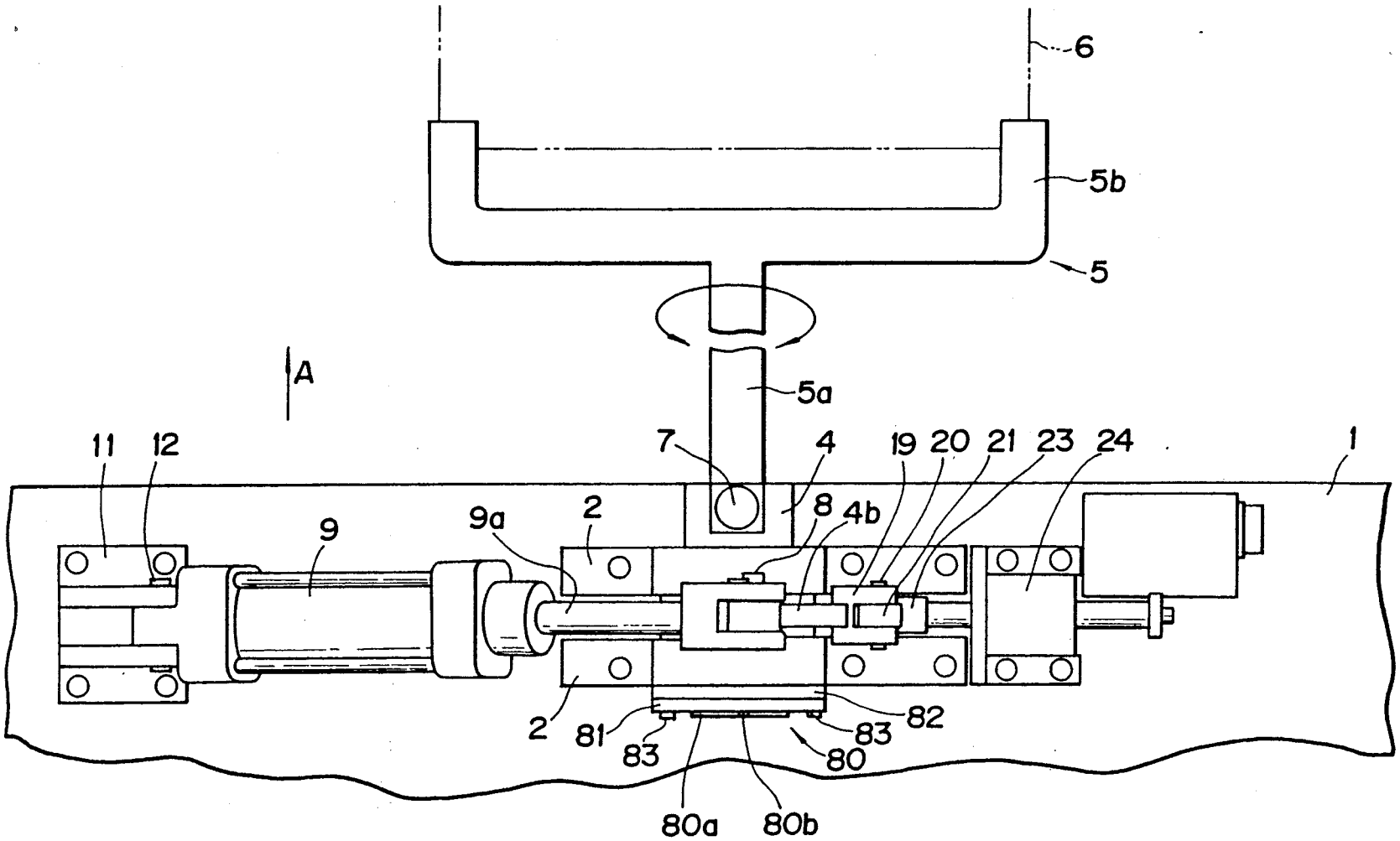
Figure 15:
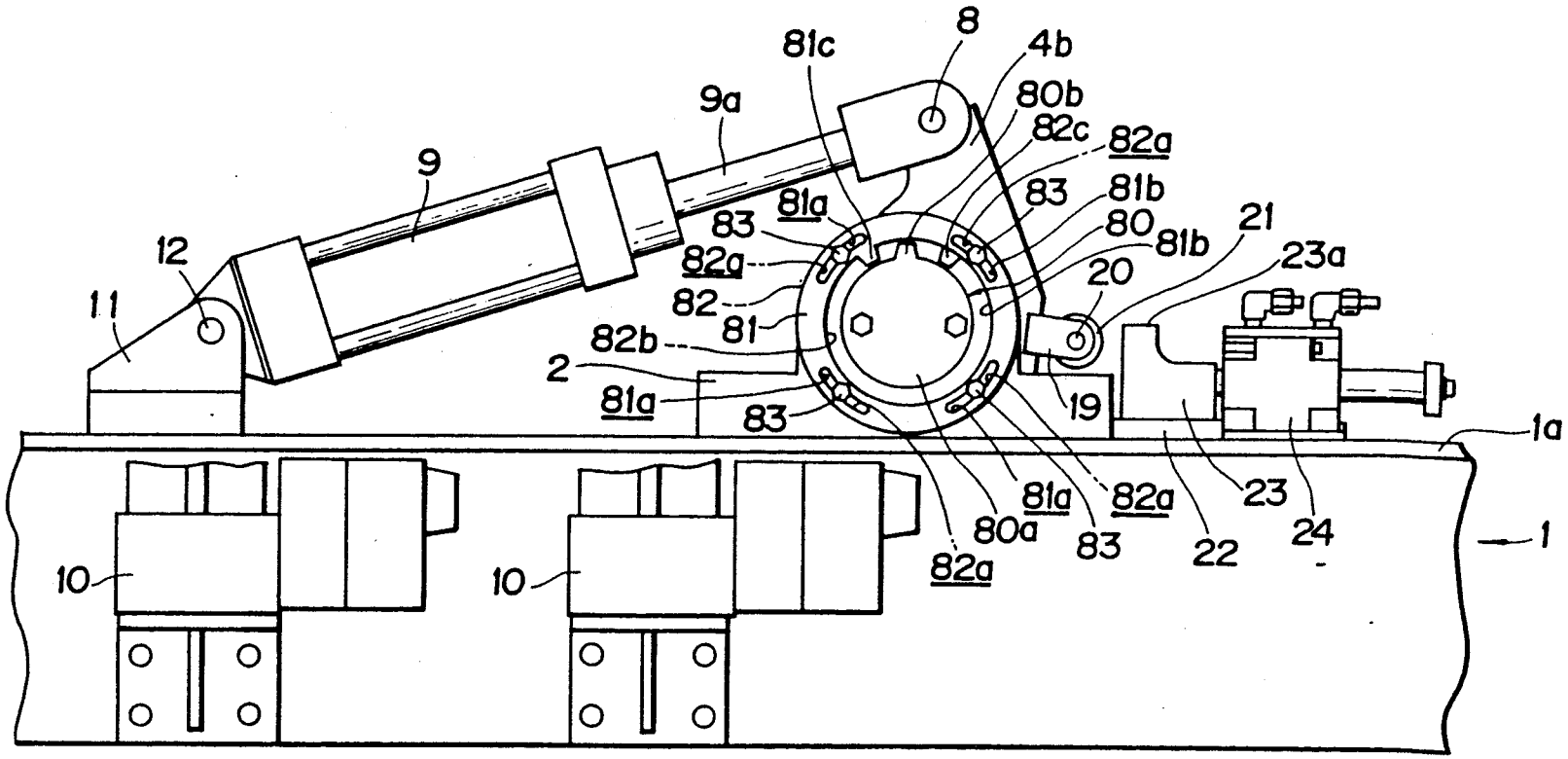
Figure 16:
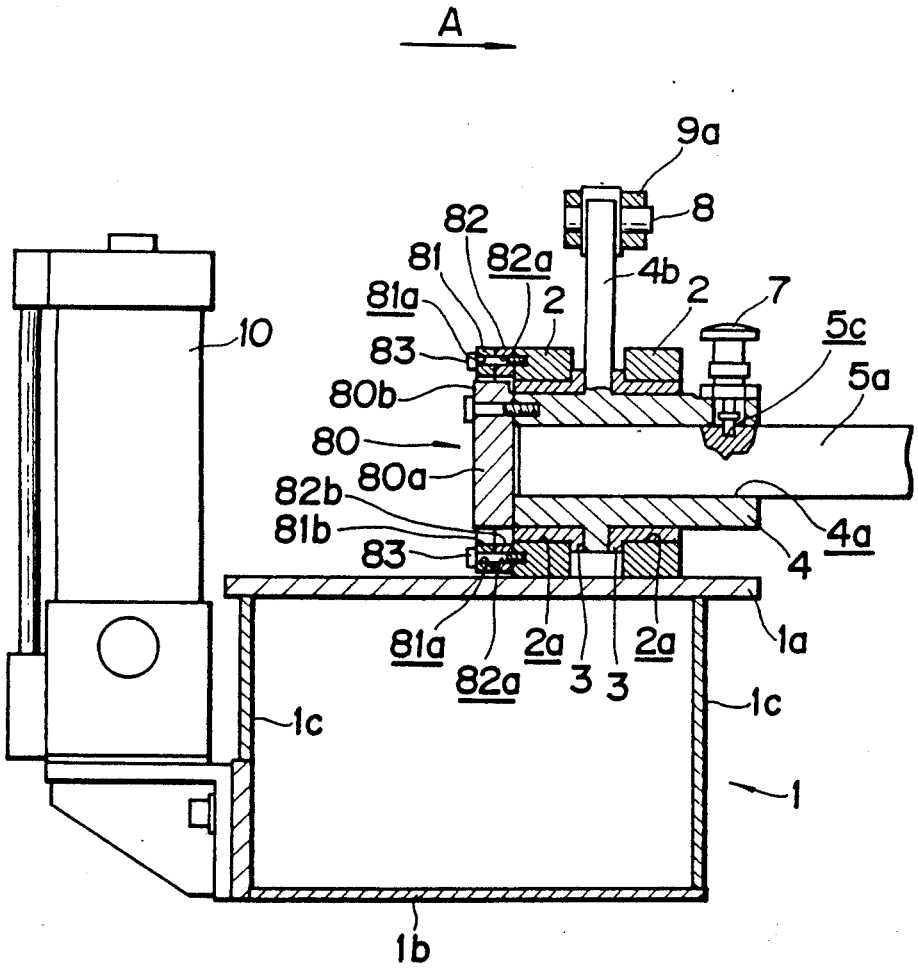

FIGS. 14 to 16 diagramatically show a finger tilting apparatus for a transfer feeder in accordance with a sixth embodiment of the present invention, respectively.

The finger tilting apparatus exemplified in the drawings includes many components of which structure is identical to those in the first embodiment and these components are represented by same reference numerals. For the purpose of simplfication, however, their repeated description will be omitted.

As shown in FIG. 16, the finger tilting apparatus is provided with an angle defining member 80 at one end of the finger holding member 4 above the upper plate 1*a* of the feed bar 1. As is best seen in FIG. 15, the angle defining member 80 includes a circular disc plate 80*a* having the same diameter as that of the finger holding member 4 and a lever portion 80*b* (serving as an angle defining lever) extending in the radial direction from the outer peripheral surface of the circular disc plate 80*a* so that it is firmly mounted on the finger holding member 4 while the center axis of the circular disc plate 80*a* is located in correct alignment with the center axis of the finger holding member 4.

Referring to FIG. 16 again, the finger tilting apparatus is provided with a pair of ring members 81 and 82 along the outer end surface of the bracket 2 situated on the outside of the feed bar 1. As shown in FIG. 15, the ring members 81 and 82 are designed in an annular contour while having a same diameter, respectively. Further, they are formed with a plurality of arc-shaped elongate holes 81*a* and 82*a* at positions corresponding to each other so that they are rotatably attached to the bracket 2 by means of a plurality of bolts 83 inserted through the elongated holes 81*a* and 82*a*. Specifically, the elongated holes 81*a* and 82*a* on the ring members 81 and 82, through which the bolts 83 are inserted, are formed in a coaxial relationship relative to the center axis of their annulation and this construction makes it possible that the ring members 81 and 82 are rotated relative to each other about the center axis of the finger holding member 4 by changing positions assumes by the elongated holes 81*a* and 82*a* relative to the bolts 83.

As shown in FIG. 16, the ring members 81 and 82 are situated outward of the outer peripheral surface of the angle defining member 80, and inner peripheral surfaces 81*b* and 82*b* of the latter are located outward of a lever portion 80*b* of the angle defining member 80.

Further, as shown in FIG. 15, the respective ring members 81 and 82 include engagement pieces 81*c* and 82*c*. The engagement pieces 81 and 82 are projected inward of the inner peripheral surfaces 81*b* and 82*b* toward their center axis and their fore ends are located in the vicinity of the outer peripheral surface of the circular disc plate 80*a* for the angle defining member 80.

With the finger tilting apparatus as constructed in the above-described manner, when the cylinder actuator 9 is actuated to displace the actuating rod 9*a* in forward and rearward directions, the finger holding member 4 is rotated via the turn lever 4*b*, and as the finger holding member 4 is rotated in that way, the lever portion 80*b* of the angle defining member 80 and the stop lever 19 are turned and the shaft portion 5*a* of the finger 5 operatively connected to the finger holding member 4 is rotated about its center axis.

An initial angle of the shaft portion 5*a* of the finger and an angle of rotation of the same are defined by operative engagement of the lever portion 80*b* of the angle defining member 80 with the engagement pieces 81*c* and 82*c* of the ring members 81 and 82, and since the engagement pieces 81*c* and 82*c* can continuously be displaced to arbitrary positions by adequate rotation of the ring members 81 and 82, the shaft portion 5*a* of the finger 5 can be held at an arbitrary angle of rotation thereof.

Accordingly, even in case where a tilt angle of the finger 5 is to be changed in accordance with a requirement for change or modification of the specification given to a work to be clamped, the requirement can be met quickly and easily.

In the sixth embodiment, an angle of rotation of the shaft portion 5*a* of the finger 5 is changed by continuously displacing the engagement pieces 81*c* and 82*c* of the ring members 81 and 82 serving as a guide member in the direction of turning movement of the lever portion 80*b* of the angle defining member 80 serving as an angle defining lever. Alternatively, an initial angle of the shaft portion 5*a* of the finger 5 and an angle of rotation of the same may be changed, e.g., by continuously displacing the guide member in the direction of extension of the angle defining lever to change a practical arm length of the latter or an initial angle of the shaft portion 5*a* of the finger 5 and an angle of rotation of the same may be changed by immovably holding the guide member, holding the angle defining lever so as to allow the angle defining lever to be displaced relative to the shaft portion 5*a* of the finger 5 in the direction of turning movement thereof and then continuously displacing the angle defining lever. It should be added that these changes or modifications are achieved with the same advantageous effects as those in the preceding embodiments.

Figure 17:
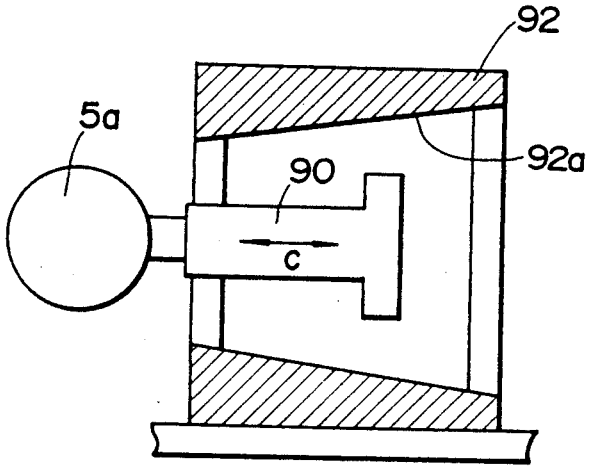
FIG. 17 is a front view schematically illustrating essential components constituting a finger tilting apparatus for a transfer feeder in accordance with a seventh embodiment of the present invention.
Figure 18:
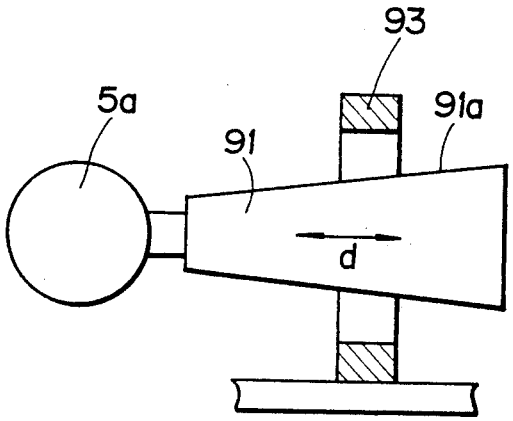
FIG. 18 is a front view schematically illustrating essential components constituting a finger tilting apparatus for a transfer feeder in accordance with an eighth embodiment of the present invention.

Next, FIG. 17 schematically illustrates a finger tilting apparatus for a transfer feeder in accordance with a seventh embodiment of the present invention and FIG. 18 likewise schematically illustrates a finger tilting apparatus for a transfer feeder in accordance with an eighth embodiment of the present invention.

According to the seventh and eighth embodiments of the present invention, at least one of an angle defining lever 90; 91 and a guide member 92; 93 is formed with a contact surface 92*a*; 91*a* which is inclined by a certain angle in the direction of extension the angle defining lever 90; 91. This arrangement makes it possible that in addition to a manner of displacement in accordance with the sixth embodiment of the present invention as described above, an initial angle of the shaft portion 5*a* of the finger 5 and an angle of rotation of the same can arbitrarily be defined even in case where the angle defining lever 90; 91 is continuously displaced relative to the shaft portion 5*a* of the finger 5 in the direction of extension thereof (in the direction of arrow marks c; d in the drawings).

Figure 19:
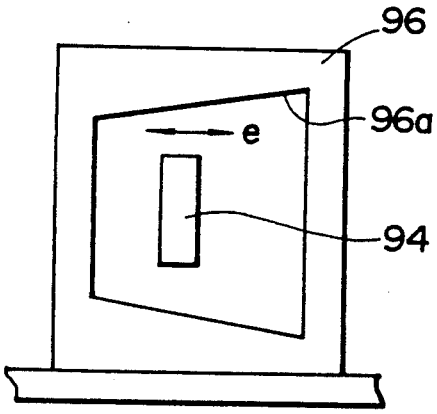
FIG. 19 is a side view schematically illustrating essential components constituting a finger tilting apparatus for a transfer finger in accordance with a ninth embodiment of the present invention.
Figure 20:
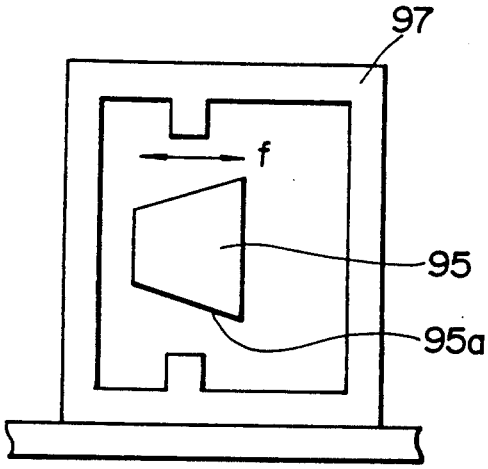
FIG. 20 is a side view schematically illustrating essential components constituting a finder tilting apparatus for a transfer feeder in accordance with a tenth embodiment of the present invention.

Next, FIG. 19 schematically illustrates a finger tilting apparatus for a transfer feeder in accordance with a ninth embodiment of the present invention and FIG. 20 likewise schematically illustrates a finger tilting apparatus for a transfer feeder in accordance with a tenth embodiment of the present invention.

According to the ninth and tenth embodiments of the present invention, at least one of an angle defining lever 94; 95 and a guide member 96; 97 is formed with a contact surface 96*a*; 95*a* which is inclined by a certain angle in the direction outward of a plane of turning movement of the angle defining lever 94; 95. This arrangement makes it possible that in addition to a manner of displacement in accordance with the sixth embodiment, at least one of the angle defining lever 94; 95 and the guide member 96; 97 can continuously be displaced in the direction of inclination of the contact surface 96*a*; 95*a* (in the direction of arrow marks e; f in the drawings) with the same advantageous effects as those in the preceding embodiments.

Figure 21:
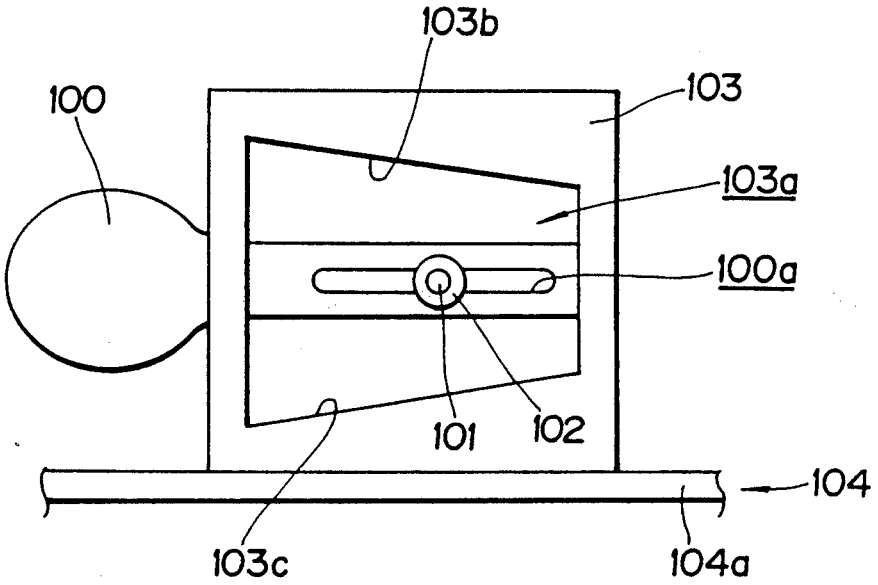
FIG. 21 is a front view schematically illustrating essential components constituting a finger tilting apparatus for a transfer feeder in accordance with an eleventh embodiment of the present invention.

Next, FIG. 21 schematically illustrate essential components constituting a finger tilting apparatus for a transfer feeder in accordance with an eleventh embodiment of the present invention. A different point of this embodiment from the sixth embodiment consists only in a structure for limiting turning movement of the angle defining lever.

Specifically, according to the eleventh embodiment, the angle defining lever 100 is formed with an elongated hole 100*a* extending in the direction of extension of the angle defining lever 100, and a roller 102 is arranged so as to slidably move along the elongated hole 100*a* via a pin 101.

On the other hand, a guide member 103 is firmly mounted on the upper plate 104*a* of a feed bar 104 and has a cut-out 103*a* formed therein. The cut-out 103*a* includes flat taper surfaces 103*b* and 103*c* (serving as a contact surface) along upper and lower peripheral edges.

Accordingly to the eleventh embodiment, an angle of rotation of the shaft portion of a finger (not shown) is determined by allowing the roller 102 on the angle defining lever 100 to come in contact with the taper surface 103*b* 103*c*, and moreover an initial angle of the shaft portion of the finger and an angle of rotation of the same are adequately changed by displacing the roller 102 along the elongated hole 100.

Further, according to the eleventh embodiment, even in case where the taper surfaces 103*b* and 103*c* are arranged to extend in parallel with the upper plate 104*a* of the feed bar 104, an initial angle of the shaft portion of the finger and an angle of rotation of the same can be changed as required, since a practical arm length of the angle defining lever 100 is changed in response to displacement of the roller 102.

In addition, according to the eleventh embodiment, an initial angle of the shaft portion (not shown) of the finger and an angle of rotation of the same are changed as required by allowing the roller 102 serving as an engagement member to be continuously displaced in the direction of extension of the angle defining lever 100. Alternatively, an initial angle of the shaft portion (not shown) of the finger and an angle of rotation of the same may be changed as required by arranging the roller 102 so as to move in the direction of turning movement of the angle defining lever 100 and then continuously displacing the roller 102. Otherwise, an initial angle of the shaft portion (not shown) of the finger and an angle of rotation of the same may be changed as required by immovably holding the roller 102 on the angle defining lever 100, arranging at least one of the angle defining lever 100 and the guide member 103 so as to move in the direction of extension of the angle defining lever 100 or in the direction of turning movement of the angle defining lever 100 and then continuously displacing the angle defining lever 100 or the guide member 103. It should be added that changes or modifications as mentioned above can be achieved with the same advantageous effects as those in the preceding embodiments. Incidentally, with respect to a structure other than the structure for allowing the guide member 103 to move in the direction of extension of the angle defining lever 100, an initial angle of the shaft portion (not shown) of the finger and an angle of rotation of the same can be changed as required, even in case where the taper surfaces 103*b* and 103*c* on the guide member 103 are arranged to extend in parallel with the upper plate 104*a* of the feed bar 104.

Figure 22:
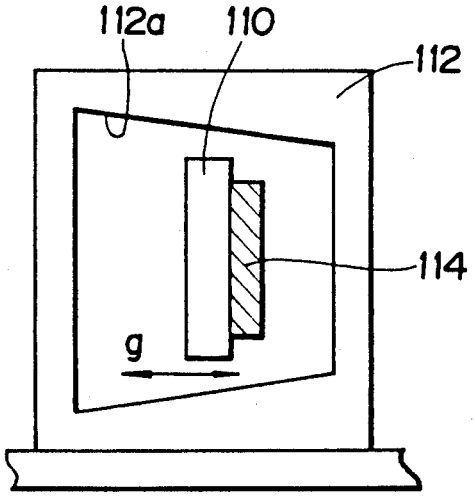
FIG. 22 is a side view schematically illustrating essential components constituting a finger tilting apparatus in accordance with a twelfth embodiment of the present invention and FIG. 23 is a side view schematically illustrating essential components constituting a finger tilting apparatus for a transfer feeder in accordance with a thirteenth embodiment of the present invention.
Figure 23:
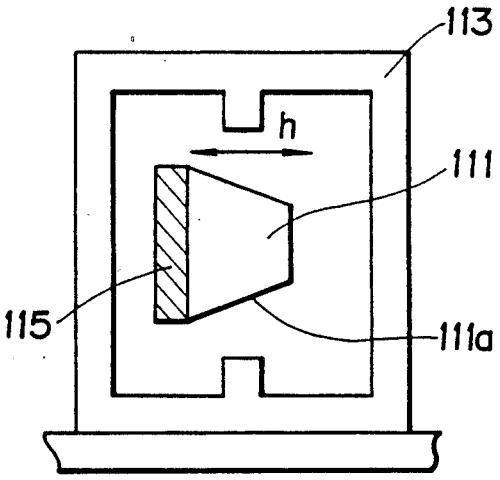

Next, FIG. 22 schematically illustrates an finger tilting apparatus for a transfer feeder in accordance with a twelfth embodiment of the present invention and FIG. 23 likewise schematically illustrates a finger tilting apparatus for a transfer feeder in accordance with a thirteenth embodiment of the present invention.

According to the twelfth and thirteenth embodiments, at least one of a roller 110; 111 and a guide member 112; 113 is formed with a contact surface 112*a*; 111*a* which is inclined in the direction of projection of the roller 110; 111. This arrangement makes it possible that in addition to a manner of displacement in accordance with the eleventh embodiment, an initial angle of the shaft portion (not shown) of a finger and an angle of rotation of the same can arbitrarily be determined, even in case where at least one of the angle defining lever 114; 115, the roller 110; 111 and the guide member 112, 113 is continuously displaced in the direction of inclination of the contact surface 112*a*; 111*a*.

INDUSTRIAL APPLICABILITY

The present invention is advantageously applicable to a transfer feeder which is preferably employable for a transfer press or the like machine.

We claim:

1. A finger tilting apparatus for a transfer feeding including a pair of feed bars arranged in parallel with each other and at least a pair of fingers for supporting a work, the fingers being located opposite to each other at opposing positions of the feed bars, the transfer feeder moving the work supported in between the fingers from one place to another by activating the pair of feed bars, the finger tilting apparatus being disposed on the pair of feed bars and comprising:

means for rotatably supporting a shaft portion of the finger about an axial center of the shaft portion relative to the feed bar, means for rotating the shaft portion of the finger, an angle defining lever and a stopping lever turned in operative association with the shaft portion, an engagement member projected from the angle defining lever in the direction outward of a plane of turning movement of the angle defining lever, a guide member coming in engagement with the engagement member to define turning movement of the angle defining lever so as to define a rotation angle of the shaft portion, and a stopper member disposed in a region of turning movement of the stop lever so as to come in and out of the region, the stopper member coming in contact with the stop lever to define turning movement of the stop lever so as to stop the shaft portion at a rotation angle different from the rotation angle defined by the angle defining lever and the guide member.

2. A finger tilting apparatus for a transfer feeder including a pair of feed bars arranged in parallel with each other and at least a pair of fingers for supporting a work, the fingers being located opposite to each other at opposing positions of the feed bars, the transfer feeder moving the work supported in between the fingers from one place to another by activating the pair of feed bars, the finger tilting apparatus being disposed on the pair of feed bars and comprising:

means for rotatably supporting a shaft portion of the finger about an axial center of the shaft portion relative to the feed bar, means for rotating the shaft portion of the finger, an angle defining lever adapted to be turned in operative association with the shaft portion of the finger, an engagement member projected from the angle defining lever in the direction outward of a plane of turning movement of the angle defining lever, a guide member coming in engagement with the engagement member to define turning movement of the angle defining lever so as to define a rotation angle of the shaft portion, and a series of stopper faces and a series of contact faces formed on at least one of the engagement member and the guide member, the other one of the engagement member and the guide member being brought in contact with one of the stopper faces and one of the contact faces to change an angle of turning movement of the angle defining lever, wherein at least one of the angle defining lever, the engagement member and the guide member is displaceably arranged so as to select either of the stopper face and the contact face.

3. A finger tilting apparatus for a transfer feeder as claimed in claim 2, wherein the guide member is formed with a series of stopper faces and a series of contact faces and it is arranged displaceably.

4. A finger tilting apparatus for a transfer feeder including a pair of feed bars arranged in parallel with each other and at least a pair of fingers for supporting a work, the fingers being located opposite to each other at opposing positions of the feed bars, the transfer feeder moving the work supported in between the fingers from one place to another by activating the pair of feed bars, the finger tilting apparatus being disposed on the pair of feed bars and comprising:

means for rotatably supporting a shaft portion of the finger about an axial center of the shaft portion relative to the feed bar, means for rotating the shaft portion of the finger, an angle defining lever adapted to be turned in operative association with the shaft portion of the finger, a pair of ring members each designed in an annular contour, the ring members being arranged to rotate about the center axis of the shaft portion of the finger, and engagement pieces projected from the peripheral edges of the ring members to come in engagement with the angle defining lever to define turning movement of the angle defining lever so as to define a rotation angle of the shaft portion, wherein at least one of the angle defining lever and the ring members is continuously displaceably arranged so as to change an angle of rotation of the shaft portion of the finger.

5. A finger tilting apparatus for a transfer feeder as claimed in claim 4, wherein the shaft portion of the finger is fitted with angle stopping means for stopping rotation of the shaft portion of the finger at a rotation angle different from the rotation angle defined by the guide member.

6. A finger tilting apparatus for a transfer feeder as claimed in claim 5, wherein said angle stopping means comprises;

a stop lever adapted to be turned in operative association with the shaft portion of the finger and a stopper member arranged in a region of turning movement of said stop lever to come in and out of said region, said stopper member being brought in engagement with the stopper lever to define turning movement of the stop lever.

7. A finger tilting apparatus for a transfer feeder including a pair of feed bars arranged in parallel with each other and at least a pair of fingers for supporting a work, the fingers being located opposite to each other at opposing positions of the feed bars, the transfer feeder moving the work supported in between the fingers from one place to another by activating the pair of feed bars, the finger tilting apparatus being disposed on the pair of feed bars and comprising:

means for rotatably supporting a shaft portion of the finger about an axial center of the shaft portion of the finger relative to the feed bar, means for rotating the shaft portion of the finger, an angle defining lever adapted to be turned in operative association with the shaft portion of the finger, an engagement member projected from the angle defining lever in the direction outward of a plane of turning movement of the angle defining lever, and a guide member having a flat contact face for coming in engagement with the engagement member to define turning movement of the angle defining lever so as to define an angle of rotation of the shaft portion of the finger, wherein the engagement member is displaceably arranged for continuous sliding movement along the contact surface to change an angle of rotation of the shaft portion of the finger.

8. A finger tilting apparatus for a transfer feeder as claimed in claim 7, wherein the shaft portion of the finger is fitted with angle stopping means for stopping rotation of the shaft portion of the finger at a rotation angle different from the rotation angle defined by the guide member.

9. A finger tilting apparatus for a transfer feeder as claimed in claim 8, wherein said angle stopping means comprises;

a stop lever adapted to be turned in operative association with the shaft portion of the finger and a stopper member arranged in a region of turning movement of said stop lever to come in and out of said region, said stopper member being brought in engagement with the stop lever to define turning movement of the stop lever.

* * * * *